US008932112B2

(12) United States Patent
Pienta et al.

(10) Patent No.: US 8,932,112 B2
(45) Date of Patent: Jan. 13, 2015

(54) CORE CLEANING APPARATUS

(75) Inventors: Daniel J. Pienta, Lambertville, MI (US); David M. Pienta, Lambertville, MI (US)

(73) Assignee: Five Brothers Properties Ltd, Lambertville, MI (US)

( * ) Notice: Subject to any disclaimer, the term of this patent is extended or adjusted under 35 U.S.C. 154(b) by 322 days.

(21) Appl. No.: 13/463,120

(22) Filed: May 3, 2012

(65) Prior Publication Data

US 2012/0220201 A1 Aug. 30, 2012

Related U.S. Application Data

(63) Continuation-in-part of application No. 12/928,231, filed on Dec. 7, 2010, now Pat. No. 8,584,566.

(51) Int. Cl.
*B24B 7/00* (2006.01)
*B65H 73/00* (2006.01)

(52) U.S. Cl.
CPC ..... *B65H 73/00* (2013.01)
USPC ..... 451/69; 451/296; 451/310

(58) Field of Classification Search
USPC ..... 451/69, 296, 310
See application file for complete search history.

(56) References Cited

U.S. PATENT DOCUMENTS 3,760,537 A * 9/1973 Bovati ..... 451/307
5,367,866 A * 11/1994 Phillips ..... 451/307
7,611,401 B1 * 11/2009 Koren ..... 451/310

* cited by examiner

*Primary Examiner* — Joseph J Hail
*Assistant Examiner* — Shantese McDonald
(74) *Attorney, Agent, or Firm* — Emch, Schaffer, Schaub & Porcello Co., LPA

(57) ABSTRACT

Apparatus for removing remnants of debris from the exterior surface of cores includes an assembly moveable from a position spaced from the exterior surface of the cores to a position adjacent the exterior surface. One or more abrasion belts are looped around rotatable shafts which move the belts to abrade the exterior surface of the cores.

3 Claims, 3 Drawing Sheets

CORE CLEANING APPARATUS

CROSS REFERENCE

The present patent application is a continuation-in-part to our prior U.S. patent application Ser. No. 12/928,231 filed Dec. 7, 2010 now U.S. Pat. No. 8,584,566.

TECHNICAL FIELD

The present invention relates generally to an apparatus for cleaning the cores of rolls of sheet form material. After the sheet form material is unwound from the core, remaining scrap sheet form material is removed and the used core is inspected. Good cores are returned to be re-used and rejected cores are disposed of.

BACKGROUND OF THE INVENTION

Many products are manufactured from elongated sheet or stock material that is shipped and stored in the form of a roll or coil. Continuous strips or webs of thin, flexible material are commonly provided wound on cores to provide rolls of sheet material. The rolls of sheet material are subsequently unwound for production of items made from the materials. Examples of these materials are plastic film, metal foil, tissue and paper.

During the manufacture of products using the sheet material, the sheet or stock material is unwound from the core. If the outer surface of the roll of sheet material is damaged or unusable, the outer surface of material must be removed to expose fresh new material. Also, after the sheet material is unwound, remnants of material remain on the cores of the rolls. In order to properly recycle and use the cores, the remnants of material must be cleaned off the core and the core must be inspected for any damage which would make the core unusable.

Such cores are valuable, particularly, if they can be recycled or reused. It is commonplace for there to be a large number and variety of cores containing various types of sheet materials. If the cores were to be disposed of instead of recycled, they would create costly, both economically and environmentally, waste. Thus, the sheet material manufacturing industry is searching for a way to quickly and inexpensively clean and recycle used cores.

One common methodology employs operators, located at a core cleaning station or at the end of the manufacturing line yielding a sharp cutting blade to cut the remaining sheet material from the core. This practice is unacceptable on multiple levels. If care is not used, the sharp cutting blades will score the surface of the core, turning it into scrap. Further, there have been numerous incidents of operators injuring themselves and others with the sharp cutting blades.

Another solution is provided in U.S. Pat. No. 4,298,173. The '173 patent discloses an apparatus for unwinding a material web wherein the leading edge of the web is grabbed by nip rollers which serve to unwind the remaining web from the core as the core is being rotated. The remaining web is then disposed of for further processing and the core is sent to a core storage area. It has been observed that apparatus such as that shown in the '173 patent demand continuous operator interface to ensure the remaining material web is successfully removed from the core.

Another proposed solution for the cleaning of cores of rolls of material is provided in U.S. Pat. No. 7,717,147. The '147 patent provides an apparatus having a stripper means comprising rollers for rotating the cores and nip rollers for catching a free end of the remaining material on each used core and a pull means for pulling the remaining material off each used core. The apparatus further includes a cleaning means for cleaning the used cores after it has been treated by the stripping means and an adhesive applicator for applying adhesive to the used cores whereby the used cores are then ready for reuse as refurbished cores for new rolls of material. The '147 apparatus suffers from the same deficiency as the '173 apparatus in that it requires operator interface to ensure that the remaining material is freely and clearly cleaned off each used core.

The present invention provides an apparatus for the cleaning of used cores.

SUMMARY OF THE INVENTION

The present invention provides an apparatus for automatically removing stock remnants from unwound cores without damaging the surfaces or ends of the cores, thus providing used cores capable of reuse. The core cleaning apparatus includes a frame that carries (1) a movable cutting blade and (2) abrasion belts looped around a pair of rotatable shafts. The assembly of the rotatable shafts and belts are carried on an arm pivotally supported for movement toward a core to be cleaned to a position away from the core. When the belts are engaged to the core and moved against the exterior surface, they readily clean debris and scrap from such surface. The apparatus of the present invention can be used with the Automatic Core Cleaning Apparatus of our pending U.S. patent application Ser. No. 12/928,231 filed Dec. 7, 2010, the disclosure of which is hereby incorporated by reference. It can also be used as a stand-alone unit.

BRIEF DESCRIPT OF THE DRAWINGS

DETAILED DESCRIPTION OF THE INVENTION

Figures 1, 1A:
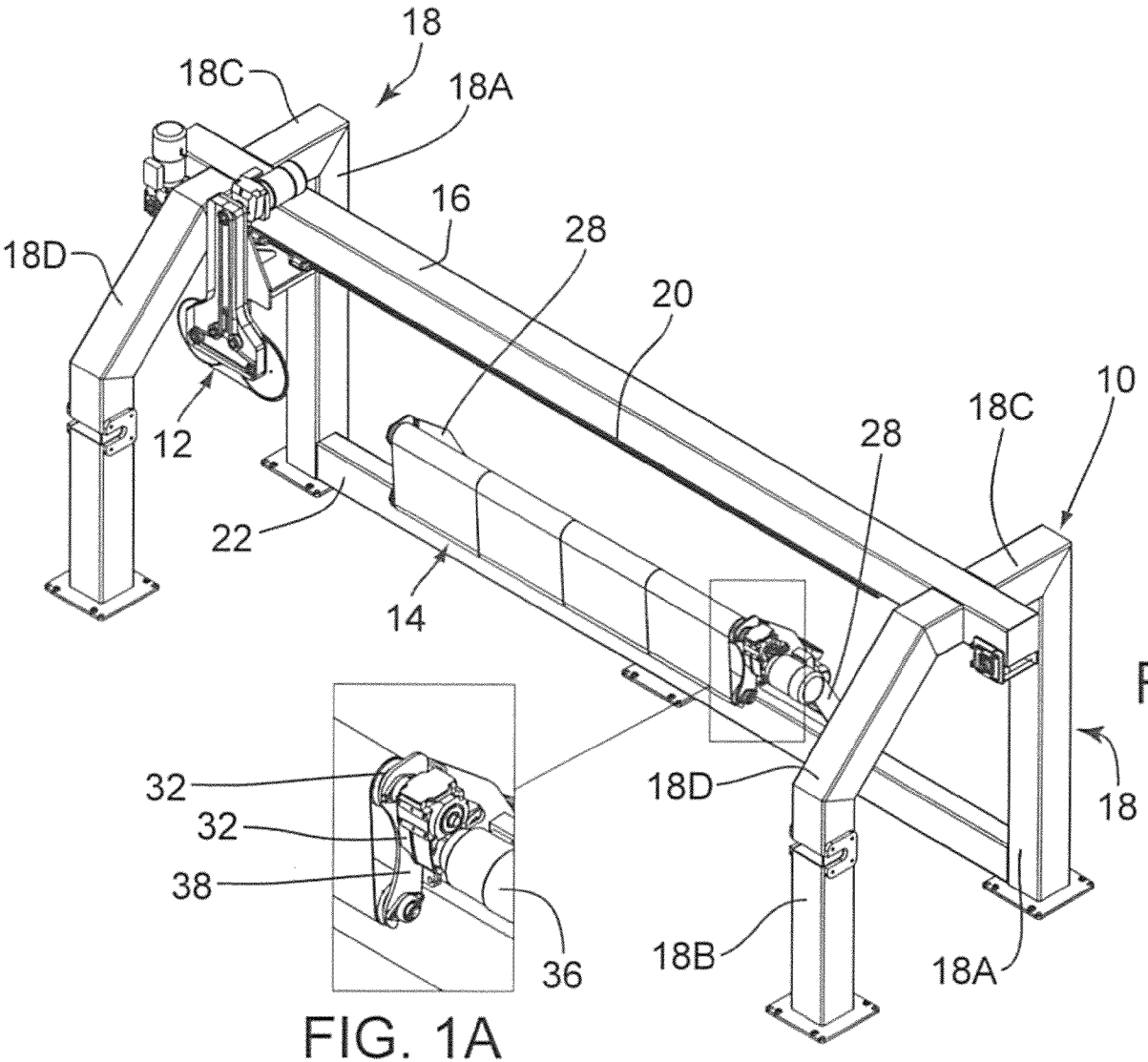
FIG. 1 is a perspective view showing the apparatus of the present invention.
FIG. 1A is an enlarged perspective view of the end portion of the assembly carrying the abrasion belts.

Referring to the drawings there is shown a frame 10 on which are mounted a cutter assembly 12 and a core abrasion assembly 14.

The frame 10 includes an upper cross member 16 extending between and supported on first and second end supports 18. The end supports 18 each include a long vertical support member 18A a short vertical support member 18B a horizontal support member 18C and an angled support member 18D extending upwardly from short support 18B and inwardly to an engagement with the horizontal support member 18C. The upper cross support member 16 is supported by and extends between and slightly beyond the end supports 18. The upper cross member 16 supports a linear slide rail 20 on which the cutter assembly 12 is supported for movement between end supports 18. The mechanism for moving the cutter assembly 12 between the end supports 18 is similar to the mechanism described in our co-pending U.S. patent application Ser. No. 12/928,231 filed Dec. 7, 2010 and forms no part of the present invention. It differs primarily in its mounting on the slide frame and the linear slide for movement relative to the core being cleaned.

The frame 10 also includes a lower support member 22 extending between end supports 18 and joined to the long vertical support members 18A. Mounted on the lower support member 22 is a core abrasion assembly 14 mounted on the lower support member 22 by means of pillow block bearings 26.

Figure 2:
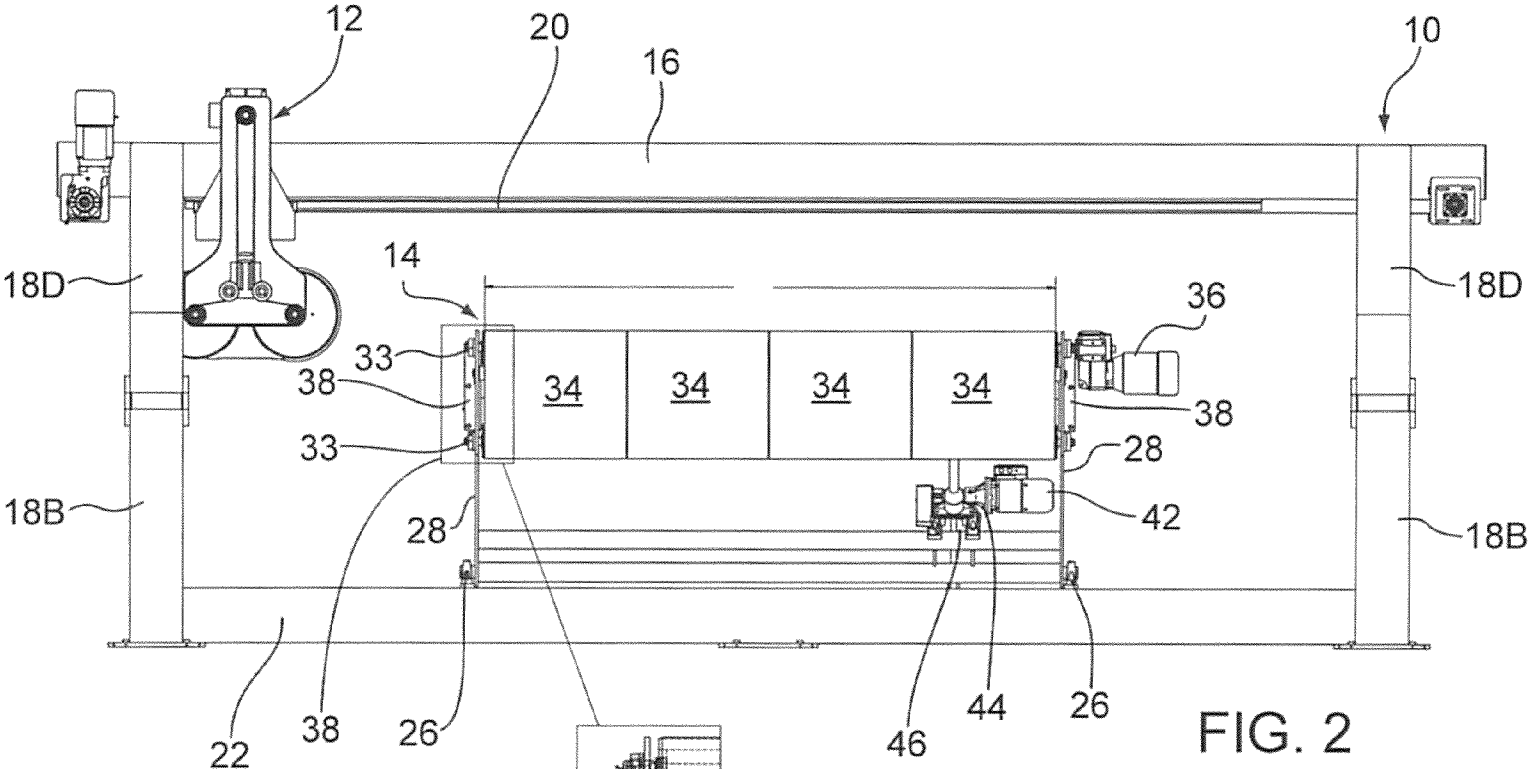
FIG. 2 is an elevational view of the apparatus.

The core abrasion assembly 14 includes a pair of spaced apart arms 28 which support carry shaft support frames 38. The shaft support frames 38 are engaged with the upper and lower rotatable shafts 32 about which are trained a plurality (4 as shown in FIGS. 1 and 2) of abrasion belts 34. The abrasion belts 34 may be a multi-ply conveyor belt material or similar material having good wear characteristics.

Figure 2A:
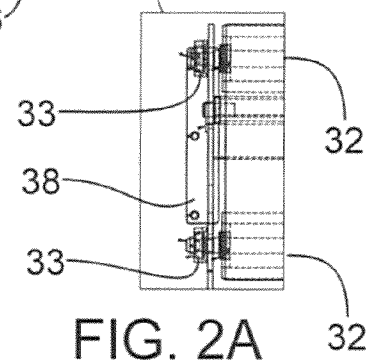
FIG. 2A is an enlarged plan view of the other end of the assembly carrying the abrasion belts.

As shown in FIG. 1A, rotation of the rotatable shafts 32 is effected by means of motor 36 mounted on one of the shaft support frames 38. The motor 36 powers rotation of the upper rotatable shaft 32 to impart movement of the abrasion belts 34 about endless loops. FIG. 2A shows the mounting of the rotatable shafts 32 on bushings 33 mounted on the shaft support frame 38.

Figure 3:
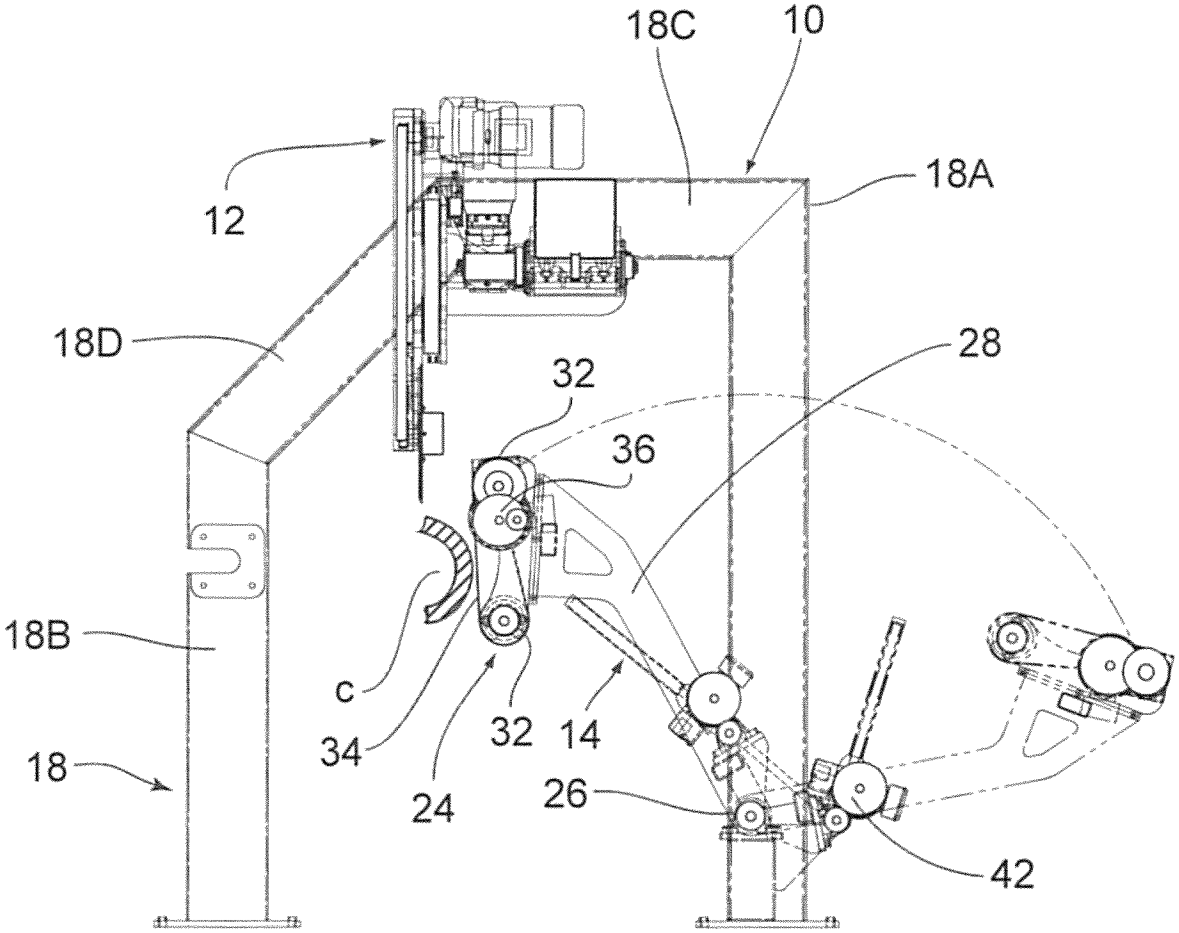
FIG. 3 is an end view of the apparatus.

The arms 28 are pivotally supported on the pillow block bearings 26. Rotation of the arms 28 from the position shown in phantom lines in FIG. 3 spaced from the core C to be cleaned to the position shown in full lines engaged to the outer surface of the core C being cleaned is effected by means of a motor 42 engaged to an actuator 44 carried by mount 46.

In operation, a core C is supported in a position for having the scrap web material cut from its exterior surface by the cutter assembly 12 as described in our co-pending application Ser. No. 12/928,231. Following such cutting operation, the motor 42 may be actuated to rotate the arms 28 and the core abrasion assembly 24 carried thereon to the position shown in full lines in FIG. 3, at which position the abrasion belts 34 are in contact with the exterior surface with the core C. Actuation of the motor 36 imparts rotation to the upper rotatable shaft 32 thereby causing the belts 34 to move around the endless loop over the shafts 32 and to clean the core C against which the belts 34 are pressed, to thereby remove any excess debris and scrap from such surface.

This invention has been described in considerable detail with reference to its preferred embodiment. However, as indicated previously, the invention is susceptible to numerous modifications, variations, and substitutions without departure from the spirit and scope of the invention as described in the foregoing detailed description and as defined in the following appended claims.

We claim:

1. An apparatus for cleaning remnant material from the exterior surface of a cylindrical core, said core having a central axis, comprising:

(a) a frame having an upper support member extending along a first straight line path and a lower support member extending along a second straight line path parallel to the first straight line path;

(b) a cutting assembly engaged with the upper support member for cutting remnant material carried on the exterior surface of the core;

(c) a core cleaning assembly mounted on the lower support member, the core cleaning assembly including;

(i) a pair of spaced apart rotatable shafts each lying on and rotatable about an axis parallel to the central axis;

(ii) one or more belts having abrasion surfaces supported on the shafts;

(iii) means for moving the shafts to carry the belts into contact with the remnant material; and (iv) means for rotating the shafts, thereby causing the one or more belts to move and abrade the cut remnant material from the exterior of the surface of the core.

2. The apparatus of claim 1 wherein the means for moving the shafts includes an arm assembly carrying the rotatable shafts pivotally mounted to the lower support member, wherein the arm assembly pivots from a position at which the belts are spaced from the exterior surface of the core to a position at which the belts are engaged with the remnant material.

3. The apparatus of claim 2 further including a motor for powering the arm assembly for pivotal movement from the spaced apart position to the engaged position and for maintaining engagement of the belts with the remnant material.

* * * * *